US005865074A

United States Patent [19]

Hsieh

[11] Patent Number: 5,865,074

[45] Date of Patent: Feb. 2, 1999

[54] BOX END WRENCH WITH STOP MEANS TO HOLD DOWN THE BOLT OR NUT TO BE TURNED

[76] Inventor: Chih-Ching Hsieh, No. 64, Lane 107, Liang Tsun Rd., Fong Yuan City, Taichung Hsien, Taiwan

[21] Appl. No.: 825,231

[22] Filed: Mar. 19, 1997

[51] Int. Cl.[6] ..... B25B 13/00

[52] U.S. Cl. ..... 81/124.3; 81/186; 81/125.1

[58] Field of Search ..... 81/124.3, 124.7, 81/125.1, 186

[56] References Cited

U.S. PATENT DOCUMENTS

| | | | |
|---|---|---|---|
| 1,384,655 | 7/1921 | Allmon | 81/124.3 |
| 2,671,368 | 3/1954 | Diebold | 81/119 |
| 2,727,418 | 12/1955 | Moon | 81/124.3 |
| 2,769,360 | 11/1956 | Cottrell et al. | 81/124.3 |
| 2,774,259 | 12/1956 | Caulkins | 81/124.3 |
| 2,801,561 | 8/1957 | Bonner | 81/124.3 |
| 4,139,036 | 2/1979 | Reagan et al. | 81/44 |
| 4,520,697 | 6/1985 | Moetteli | 81/124.3 |
| 4,699,029 | 10/1987 | Kelly et al. | 81/124.3 |
| 5,136,902 | 8/1992 | Ma | 81/119 |
| 5,218,891 | 6/1993 | Olson et al. | 81/124.3 |
| 5,230,263 | 7/1993 | Kwaka | 81/124.3 |
| 5,307,713 | 5/1994 | White | 81/119 |

*Primary Examiner*—David A. Scherbel
*Assistant Examiner*—Lee Wilson
*Attorney, Agent, or Firm*—Varndell Legal Group

[57] ABSTRACT

A box end wrench having a split binding ring mounted in an annular groove at internal angles of a box of a first box end thereof for stopping the wrench from escaping out of the bolt or nut to be turned with the first box end, and a plurality of smoothly curved raised Portions at internal angles of a box of a second box end thereof for stopping the wrench from escaping out of the bolt or nut to be turned with the second box end.

2 Claims, 13 Drawing Sheets

BOX END WRENCH WITH STOP MEANS TO HOLD DOWN THE BOLT OR NUT TO BE TURNED

BACKGROUND AND SUMMARY OF THE INVENTION

The present invention relates to box end wrenches, and more particularly to such a box end wrench which has stop means adapted for holding down the bolt or nut to be turned.

A box end of a box end wrench or ratchet box end wrench or a socket for socket wrench, has a plurality of internal angles (the number of the internal angles can be 4, 6, 8, 12, 16 or 20) by which the box end can be positively attached to the bolt or nut to be turned (see FIGS. 1 and 2). However, when the wrench is turned the box end of the wrench may slip from the bolt or nut, resulting in the bolt or the nut is not to turned positively. FIGS. 3 and 5 show a wrench having a spring-supported stop ball suspended above the box of the box end and adapted for stopping the wrench from escaping out of the bolt or nut to be turned. However, this arrangement is still not satisfactory in function, because the stop ball wears quickly with use, and the spring force of the spring which supports the stop ball tends to be surpassed by the turning for applied to the wrench. FIGS. 4 and 6 show a wrench having a sliding stop plate retractably suspended above the box of the box end and adapted for stopping the wrench from escaping out of the bolt or nut to be turned. However, the arrangement of the sliding stop plate limits the maximum turning angle of each turning step of the wrench.

According to one embodiment of the present invention, a wrench is provided having a split binding ring mounted in an annular groove at internal angles of a box of a box end thereof for stopping wrench from escaping out of the bolt or nut to be turned. According to another embodiment of the present invention, a wrench is provided having a plurality of smoothly curved raised portions at internal angles of a box of a second box end thereof for stopping the wrench from escaping out of the bolt or nut to be turned.

DETAILED DESCRIPTION OF THE PREFERRED EMBODIMENT

Referring to FIGS. 7, 8, 11 and 13, a box 51 of a box end of a wrench 5 comprises an annular groove 510 around the inside wall, and a split binding ring 52 mounted in the annular groove 510 and disposed at internal angles thereof. When the box 51 of the wrench 5 is attached to the bolt (nut) to be turned, the split binding ring 52 is forced into engagement with the bolt (nut) to stop the box end of the wrench 5 from escaping out of the bolt (nut)!

Figure 1:
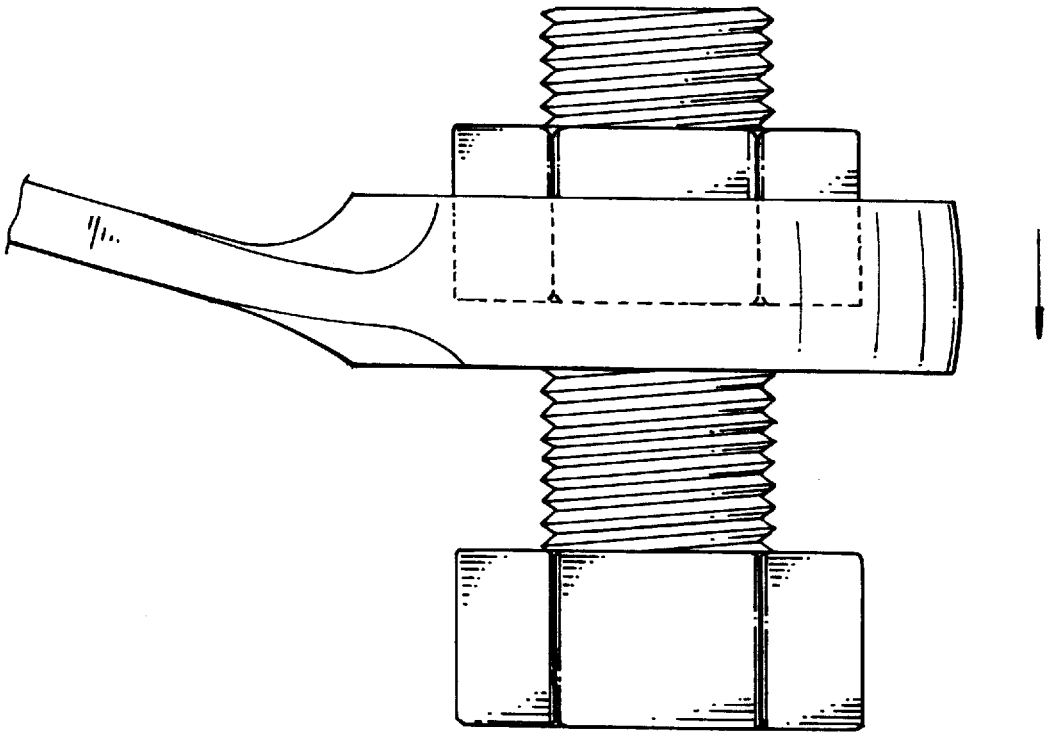
Fig . 1 PRIOR ART
FIG. 1 is a sectional view showing a box end of a box end wrench mounted on a bolt according to the prior art.
Figure 2:
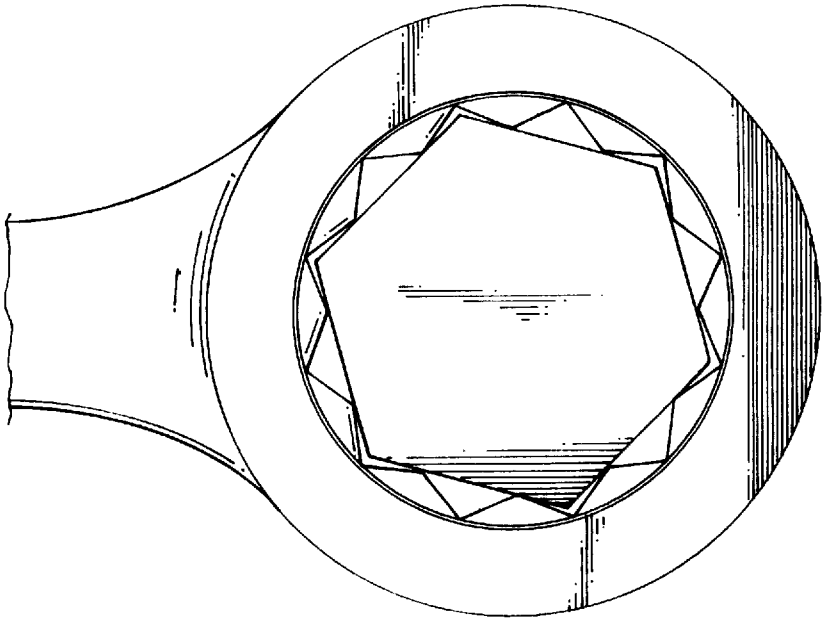
Fig. 2 PRIOR ART
FIG. 2 shows the box end wrench of FIG. 1 attached to the periphery of the head of the bolt
Figure 3:
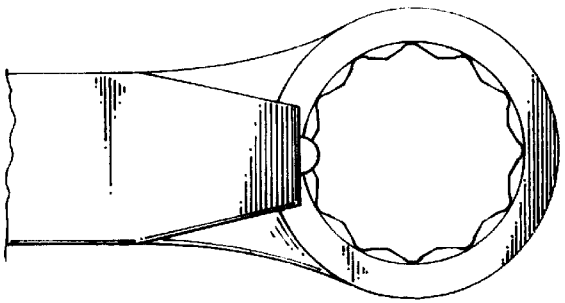
Fig. 3 PRIOR ART
FIG. 3 is a top view of a part of a wrench with a stop ball according to the prior art.
Figure 4:
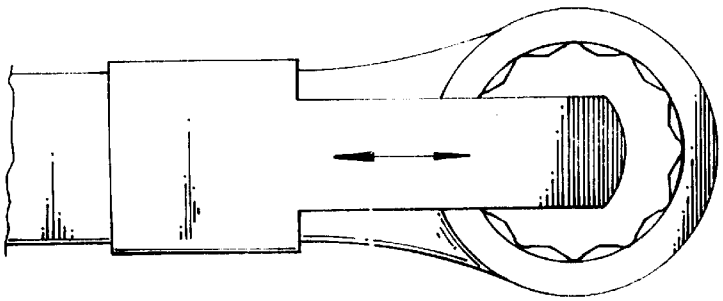
Fig. 4 PRIOR ART
FIG. 4 is a top view of a part of wrench with a sliding stop plate according to the prior art.
Figure 5:
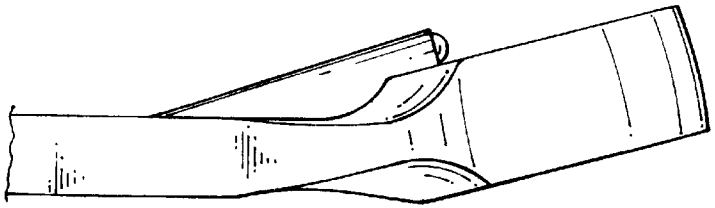
Fig. 5 PRIOR ART
FIG. 5 is a side view of FIG. 3.
Figure 6:
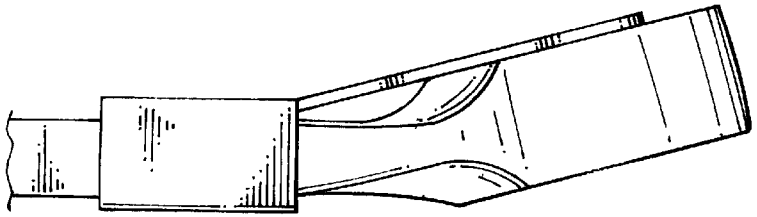
Fig. 6 PRIOR ART
FIG. 6 is a side view of FIG. 4.
Figure 7:
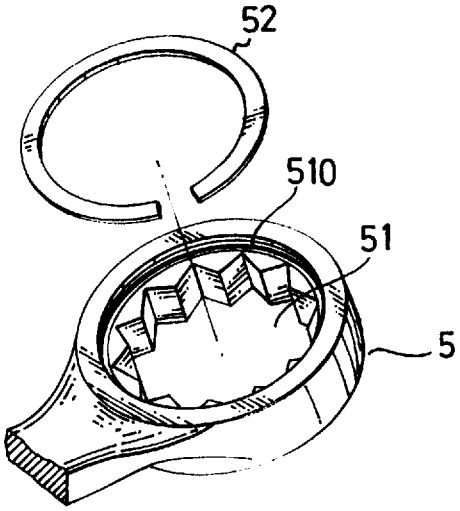
FIG. 7 is an exploded view of a box end of a wrench according to the present invention, showing the relationship between the split binding ring and the box.
Figure 8:
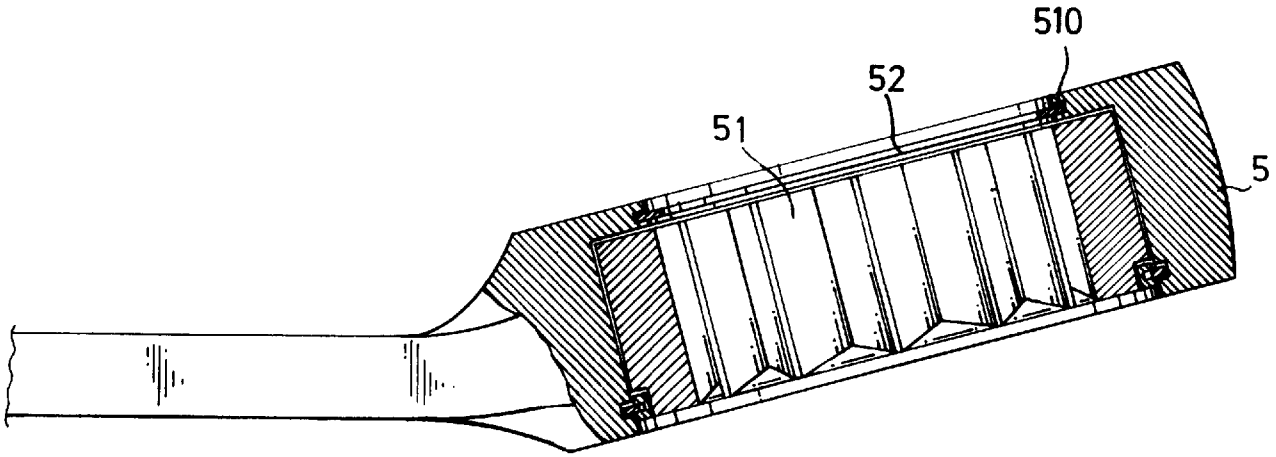
FIG. 8 is a sectional view showing a split binding ring mounted in an annular groove inside a box of a box end of a wrench according to the present invention.
Figure 9:
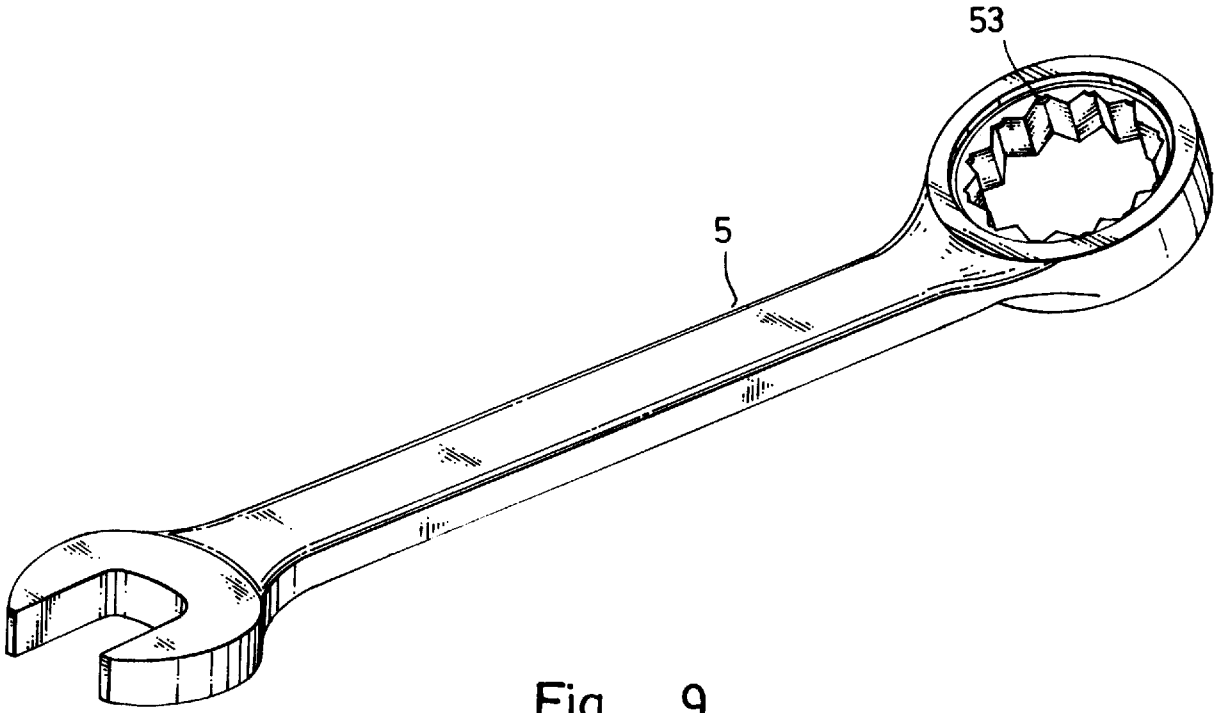
FIG. 9 is an elevational view of a wrench according to one embodiment of the present invention, showing smoothly curved raised portions disposed at internal angles of the box of the box end of the wrench.
Figure 10:
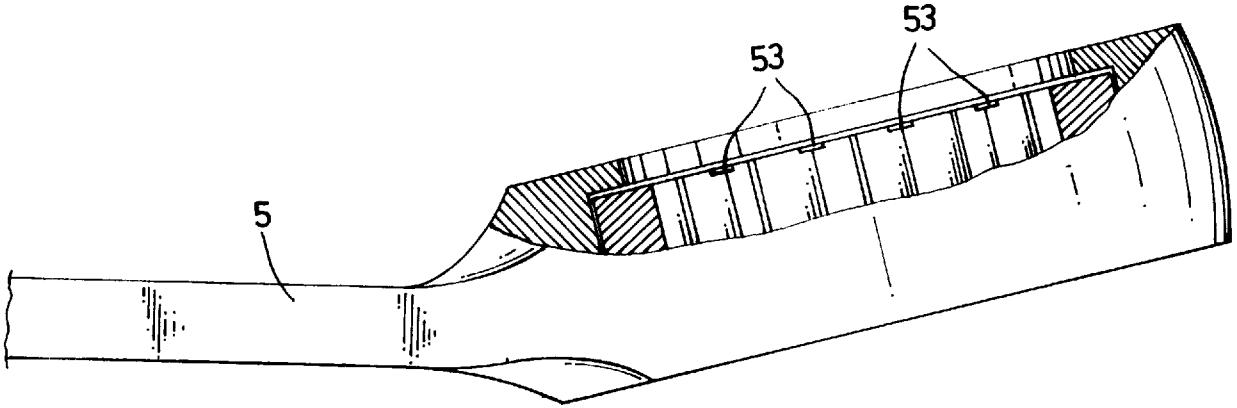
FIG. 10 is a sectional view in an enlarged scale of the box end of the wrench shown in FIG. 9.
Figure 11:
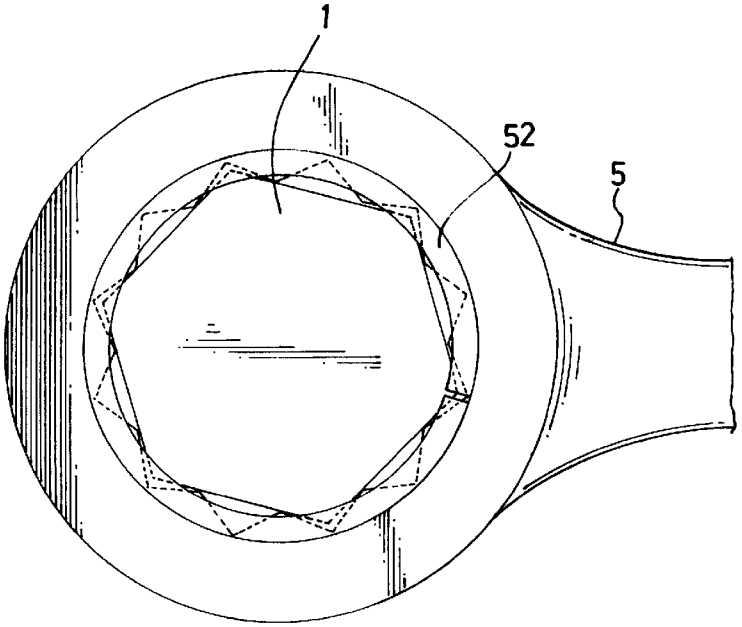
FIG. 11 is a top plain view showing the split binding ring of box end forced into engagement with the bolt according to the present invention.
Figure 12:
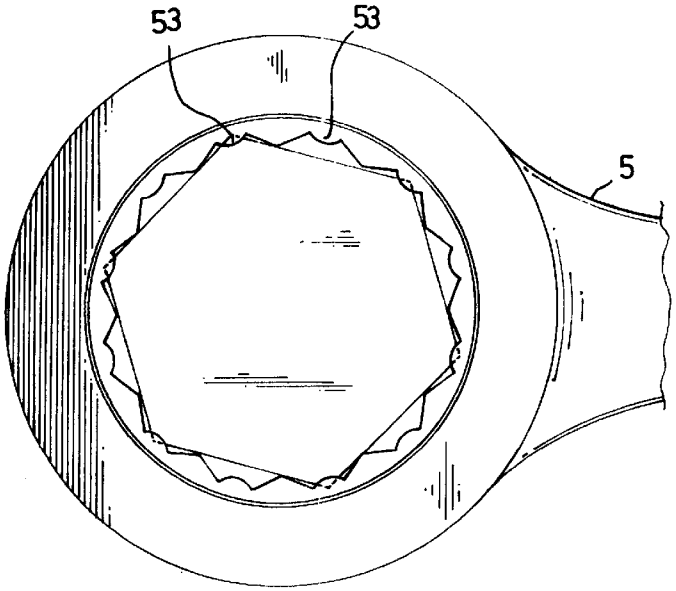
FIG. 12 is a top plain view showing the smoothed curved raised portions of the box end forced into engagement with the bolt according to the present invention.

Referring to FIGS. 9, 10 and 12, the box 51 comprises a plurality of smoothly curved raised portions 53 respectively disposed at the internal angles thereof adapted for stopping the box from escaping out of the bolt (nut) to be turned. The raised portions 53 are made on the box 51 of the wrench 5 in integrity by stamping.

The present invention can be employed to a ratchet box end wrench 6 (see FIG. 14), a box end wrench 7 (see FIG. 15), or a socket for socket wrench 8. The number of the internal angles of the box of the box end wrench or the socket for socket wrench can be 4, 6, 8, 12, 16 or 20.

Figure 13:
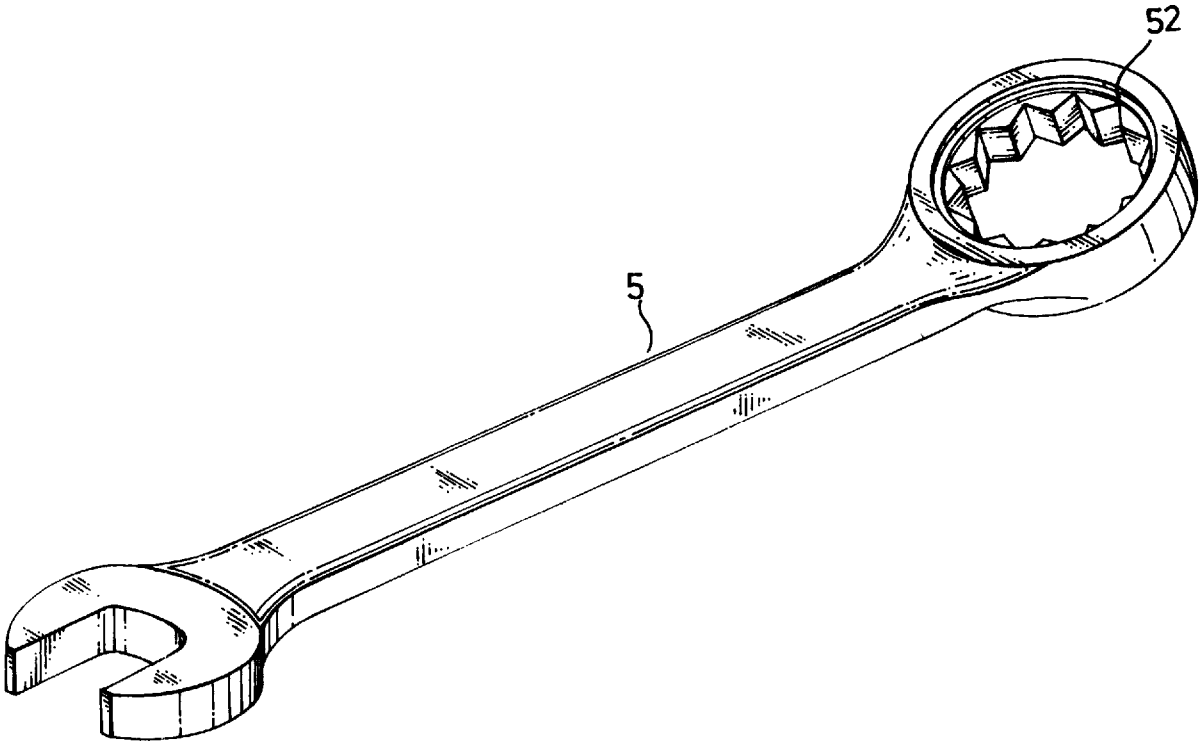
FIG. 13 is an elevational view of a wrench according to another embodiment of the present invention, showing a split binding ring mounted in the box of the box end of the wrench.
Figure 14:
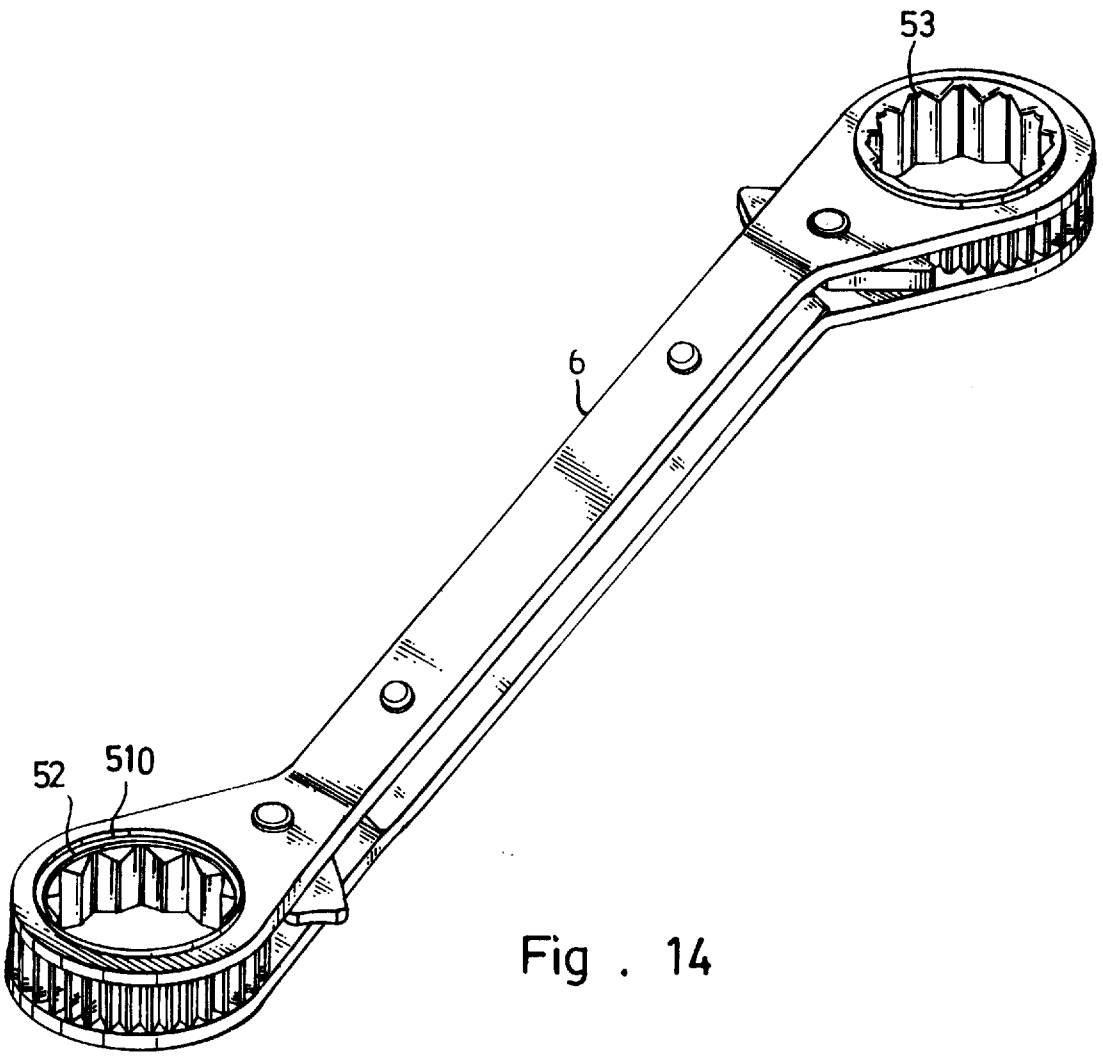
FIG. 14 is an elevational view of a ratchet box end wrench according to still another embodiment of the present invention, showing a split binding ring mounted in one box end of the wrench, and smoothly curved raised portions formed on the other box end of the wrench at its internal angles.
Figure 15:
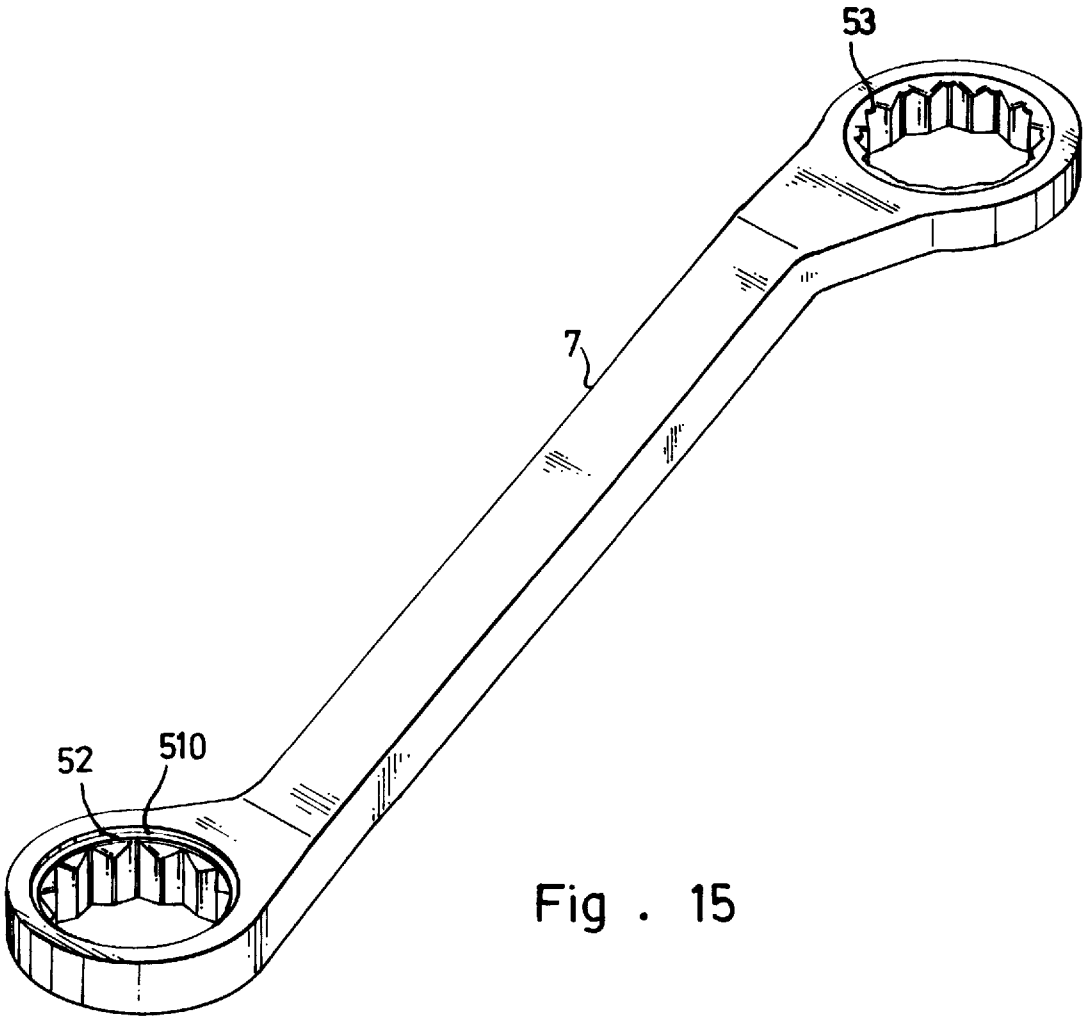
FIG. 15 is an elevational view of a box end wrench according to still another embodiment of the present invention, showing a split binding ring mounted in one box end of the wrench, and smoothly curved raised portions formed on the other box end of the wrench at its internal angles.
Figure 16:
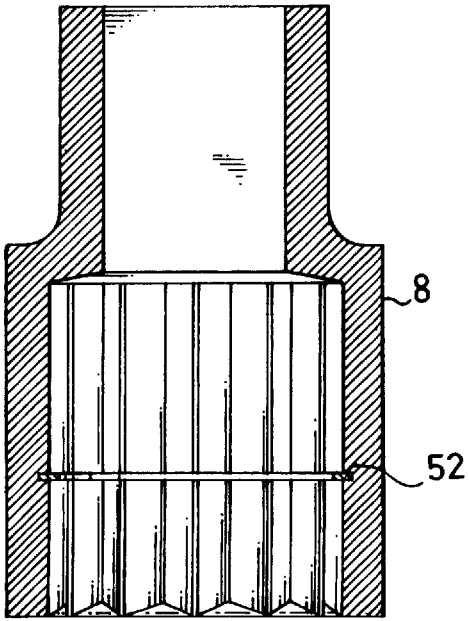
FIG. 16 is a sectional view of a socket for socket wrench according to the present invention, showing a split binding ring mounted inside the socket.

In FIGS. 14 and 15, the box wrench 6 or 7 has one box mounted with a split binding ring 52, and the other box made with smoothly curved raised portions 53. In FIG. 13 , the wrench has one end terminating in a box end mounted with a split binding ring 52, and an opposite end terminating in an open end.

I claim:

1. A wrench comprising a first box end at one end, said first box end defining a box and a plurality of internal angles within said box, wherein an annular groove is formed internally around said box, and a split binding ring is mounted in said annular groove and disposed at said internal angles and adapted for securing said first box end to the bolt or nut to be turned with said first box end, and preventing said first box end from escaping out of the bolt or nut to be turned.

2. The wrench of claim 1, wherein a second box end is formed at an end of said wrench opposite said first end, said second end having a plurality of smoothly curved raised portions respectively disposed at internal angles thereof and adapted for securing said second box end to the bolt or nut be turned with said second box end, and preventing said second box end from escaping out of the bolt or nut to be turned.

* * * * *